US009364061B2

(12) United States Patent
Lewis

(10) Patent No.: US 9,364,061 B2
(45) Date of Patent: Jun. 14, 2016

(54) ARTICLES HAVING AN EXPANDABLE AND REINFORCEABLE STORAGE CAVITY

(71) Applicant: Quené Lewis, North Hollywood, CA (US)

(72) Inventor: Quené Lewis, North Hollywood, CA (US)

( * ) Notice: Subject to any disclaimer, the term of this patent is extended or adjusted under 35 U.S.C. 154(b) by 235 days.

(21) Appl. No.: 13/874,817

(22) Filed: May 1, 2013

(65) Prior Publication Data

US 2014/0326371 A1 Nov. 6, 2014

(51) Int. Cl.

| | |
|---|---|
| ***A45C 7/00*** | (2006.01) |
| *A45C 5/06* | (2006.01) |
| *A45C 13/02* | (2006.01) |
| *A45C 13/10* | (2006.01) |

(52) U.S. Cl.

CPC ..... *A45C 7/0068* (2013.01); *A45C 5/06* (2013.01); *A45C 13/02* (2013.01); *A45C 13/103* (2013.01); *A45C 13/1023* (2013.01)

(58) Field of Classification Search

CPC ..... A45C 7/0068; A45C 7/0086; A45C 5/14; A45C 7/0077; A45C 7/0036; A45C 13/103; A45C 13/1023; A45C 13/02; A45C 5/06

See application file for complete search history.

(56) References Cited

U.S. PATENT DOCUMENTS

| | | | |
|---|---|---|---|
| 285,305 | A | 9/1883 | Peirson |
| 1,283,170 | A | 10/1918 | Hauser |
| 1,559,307 | A | 10/1925 | Bernardo |
| 1,581,985 | A | 4/1926 | Sachs |
| 1,895,744 | A | 1/1933 | Arnold |
| 2,078,624 | A | 4/1937 | Wolff et al. |
| 2,130,502 | A | 9/1938 | Lindemann |
| 2,258,942 | A | 10/1941 | White et al. |
| 2,369,943 | A | 2/1945 | Broudy |
| 2,394,332 | A | 2/1946 | Salem |
| 2,463,993 | A | 3/1949 | Meyers |
| 2,540,165 | A | 2/1951 | Fiel |
| 2,555,122 | A | 5/1951 | Gallo |
| 2,555,778 | A | 6/1951 | Blume |
| 2,788,823 | A | 4/1957 | Walser |
| 2,801,666 | A | 8/1957 | Steele |
| 2,845,973 | A | 8/1958 | Strong |
| 2,904,091 | A | 9/1959 | Reed |
| 3,045,900 | A | 7/1962 | Zekendorf |
| 3,194,291 | A | 7/1965 | Oakes |
| 3,202,191 | A | 8/1965 | Kaplan |
| 3,292,747 | A | 12/1966 | Dawson |
| 3,587,698 | A | 6/1971 | Ritter |
| 3,696,850 | A | 10/1972 | Rosenblum |
| 3,870,132 | A | 3/1975 | Hanley |
| 3,963,102 | A | 6/1976 | Carp |

(Continued)

OTHER PUBLICATIONS

PCT/US2014/036385 Internatonal Search Report dated Sep. 4, 2014.

*Primary Examiner* — Tri Mai
(74) *Attorney, Agent, or Firm* — Banner & Witcoff, Ltd.

(57) ABSTRACT

An apparatus is disclosed, the apparatus including a primary storage cavity, an expandable and collapsible secondary storage cavity, and at least one pair of rigid reinforcing structures contained within the secondary storage cavity. In some embodiments, the apparatus is a handbag, purse, tote, or clutch. In addition, a handbag is disclosed, the handbag including a primary storage cavity, an expandable and collapsible secondary storage cavity, at least one pair of rigid reinforcing structures contained within the secondary storage cavity, and a fastening mechanism configured to fasten the materials defining the secondary storage cavity in a collapsed position.

19 Claims, 3 Drawing Sheets

(56) References Cited

U.S. PATENT DOCUMENTS

| | | | | | |
|---|---|---|---|---|---|
| 3,989,080 | A | | 11/1976 | Koszegi | |
| 4,078,595 | A | | 3/1978 | Mittelmann | |
| 4,153,146 | A | | 5/1979 | Patton et al. | |
| 4,171,011 | A | | 10/1979 | Kopin | |
| 4,236,615 | A | | 12/1980 | Ginat | |
| 4,312,431 | A | | 1/1982 | Corey | |
| 4,354,542 | A | | 10/1982 | Gerch | |
| 4,361,215 | A | | 11/1982 | Sawai | |
| 4,453,623 | A | | 6/1984 | Horii | |
| 4,613,039 | A | | 9/1986 | Shaw et al. | |
| 4,941,603 | A | | 7/1990 | Creamer et al. | |
| 5,090,526 | A | | 2/1992 | Jacober | |
| 5,209,279 | A | * | 5/1993 | Wilson | 150/111 |
| 5,307,908 | A | | 5/1994 | Shyr et al. | |
| 5,413,199 | A | | 5/1995 | Clement | |
| 5,490,623 | A | | 2/1996 | McConnell | |
| 5,749,447 | A | | 5/1998 | Hersh et al. | |
| 5,826,770 | A | * | 10/1998 | Chuang | G06F 1/1628 190/100 |
| 5,873,504 | A | | 2/1999 | Farmer | |
| 5,954,193 | A | | 9/1999 | Bartee | |
| 6,213,268 | B1 | | 4/2001 | Dancyger | |
| 6,237,660 | B1 | | 5/2001 | Giardino | |
| 6,237,764 | B1 | | 5/2001 | Kastelic | |
| 6,561,329 | B2 | | 5/2003 | Stobbs, II et al. | |
| 6,920,993 | B2 | * | 7/2005 | Sheng-Bin | 220/6 |
| 7,232,018 | B1 | * | 6/2007 | Salander | 190/108 |
| 7,624,777 | B2 | | 12/2009 | Paller | |
| 7,703,646 | B2 | | 4/2010 | Chen | |
| 7,789,115 | B2 | | 9/2010 | Preciado et al. | |
| 7,845,377 | B2 | | 12/2010 | Edwards, Jr. et al. | |
| 8,869,960 | B2 | * | 10/2014 | Mangano | 190/18 A |
| 2002/0125669 | A1 | * | 9/2002 | Chang | A45C 5/14 280/79.11 |
| 2004/0099496 | A1 | * | 5/2004 | Hollingsworth | 190/111 |
| 2004/0195286 | A1 | | 10/2004 | Greenhalgh et al. | |
| 2006/0027293 | A1 | | 2/2006 | Willems | |
| 2006/0254952 | A1 | | 11/2006 | Trevino et al. | |
| 2010/0243695 | A1 | | 9/2010 | Vock | |
| 2011/0146856 | A1 | | 6/2011 | Vancelette | |
| 2012/0012235 | A1 | | 1/2012 | Freiman | |
| 2012/0121210 | A1 | | 5/2012 | Meyer et al. | |
| 2013/0020160 | A1 | * | 1/2013 | Mangano | 190/18 A |
| 2013/0048164 | A1 | | 2/2013 | Fleming | |

* cited by examiner

ARTICLES HAVING AN EXPANDABLE AND REINFORCEABLE STORAGE CAVITY

FIELD OF THE INVENTION

This invention relates to apparatuses and articles for carrying personal items, such as handbags, purses, totes, clutches, and the like. In particular, this invention relates to apparatuses having a primary storage cavity, an expandable and collapsible secondary storage cavity, and at least one pair of rigid reinforcing structures contained within the secondary storage cavity to reinforce the cavity after it is expanded.

BACKGROUND

Handbags and similar articles are often used to carry a variety of personal objects. A user owning such an article, however, may occasionally have the need to carry additional items that will not fit within the storage area of the article, or that the user may not desire to place in proximity with the items normally carried within the storage area. These situations force to the user to periodically switch to a larger, more cumbersome bag having additional storage or commit to always using such a bag to be prepared for these circumstances. Additionally, carrying heavy items or a large number of items in, e.g., a handbag can potentially cause damage to fragile or easy altered personal items, especially when such items are in a storage area at or near the bottom of the bag and therefore will bear the weight of the additional items whenever the user sets the bag down. Finally, while users may need additional storage or the ability to protect certain personal items, consumers often desire that the features of handbags and similar articles are still visually and aesthetically pleasing.

It is an object of certain embodiments of the invention to provide apparatuses, articles, and handbags that, amongst other features and advantages, address these objectives. It is an object of certain embodiments of the invention to provide an apparatus including a primary storage cavity, an expandable and collapsible secondary storage cavity, at least one pair of rigid reinforcing structures contained within the secondary storage cavity, and a fastening mechanism configured to fasten the materials defining the secondary storage cavity in a collapsed position. It is an object of certain other embodiments of the invention to provide a handbag having these and other features.

SUMMARY

This Summary provides an introduction to some general concepts relating to this invention in a simplified form that are further described below in the Detailed Description. This Summary is not intended to identify key features or essential features of the invention.

In accordance with one aspect of the invention, an apparatus is disclosed, the apparatus comprising a primary storage cavity defined by at least a first primary side wall, a second primary side wall and a divider, where the divider defines a bottom wall of the primary storage cavity, an expandable and collapsible secondary storage cavity, where the secondary storage cavity is disposed below the primary storage cavity when expanded, where the secondary storage cavity is defined by at least the divider, a first secondary side wall, a second secondary side wall and a secondary bottom wall when expanded and where the secondary side walls connect the divider and the secondary bottom wall. In this aspect of the invention, the apparatus further comprises at least one pair of rigid reinforcing structures contained within the secondary storage cavity, each reinforcing structure being configured to be selectively secured adjacent to a secondary side wall on the opposing side of the secondary cavity from the other member of the pair, where the reinforcing structures span the distance between the divider and the secondary bottom wall when secured. In this aspect, the apparatus further comprises a secondary access mechanism attached to one of the secondary side walls, the secondary access mechanism being configured to selectively allow access to the secondary storage cavity when the storage cavity is expanded, and a fastening mechanism being configured to engage to fasten the secondary side walls, the secondary bottom wall and the reinforcing structures in a collapsed position adjacent to the divider when the reinforcing structures are unsecured and the secondary storage cavity is collapsed, and being configured to disengage to selectively release the secondary side walls, the secondary bottom wall and the reinforcing structures from the collapsed position and allowing the secondary cavity to expand away from the divider.

In some embodiments, the secondary side walls comprise a pliable material. In various embodiments the reinforcing structures comprise a first edge and a second edge opposite the first edge, and the first edge is attached to a wall defining the secondary cavity on or near the connection of a secondary side wall and either the divider or the secondary bottom wall, where the first edge defines a rotation axis and the reinforcing structures can be rotated about the axis from an unsecured position to a secured position, and the reinforcing structures are substantially parallel to the divider and secondary bottom wall when in the unsecured position, and where the reinforcing structures are adjacent to a secondary side wall and substantially perpendicular to the divider and secondary bottom wall when in the secured position.

In certain embodiments, the primary storage cavity is defined by the first primary side wall, the second primary side wall, a third primary side wall, a fourth primary side wall, and the divider, and the secondary storage cavity, when expanded, is defined by the first secondary side wall, the second secondary side wall, a third secondary side wall, a fourth secondary side wall, the divider, and the secondary bottom wall. In some embodiments, the reinforcing structures and secondary storage cavity comprise a securing mechanism configured to automatically secure the reinforcing structures in a secured position when the reinforcing structures are positioned adjacent to one of the secondary side walls and are substantially perpendicular to the divider and secondary bottom wall.

In various embodiments, the securing mechanism comprises hook and loop fasteners positioned to automatically engage each other when the reinforcing structures are positioned adjacent to a secondary side wall, a deformable tab and corresponding groove positioned to automatically engage each other when the reinforcing structures are positioned adjacent to a secondary side wall, or a combination thereof. In certain embodiments, the reinforcing structures comprise a thermoplastic material, a metal, a metallic alloy, or a combination thereof. In some embodiments, the pliable material is leather, artificial leather, canvas, suede, polyvinylchloride or a combination thereof. In some embodiments, the apparatus further comprises a primary access mechanism configured to selectively allow access to the primary storage cavity through the top or side of the apparatus and a carrying attachment connected to one or more of the walls defining the primary storage cavity.

In accordance with another aspect of the invention, a handbag is disclosed, the handbag comprising a primary storage cavity defined by at least one primary side wall and a divider, where the divider defines a bottom wall of the primary storage cavity, and an expandable and collapsible secondary storage cavity, where the secondary storage cavity is disposed below the divider when expanded, and is defined by at least one secondary wall, the divider, and a secondary bottom wall. In this aspect of the invention, the handbag further comprises at least one pair of rigid reinforcing structures contained within the secondary storage cavity, each reinforcing structure being configured to be selectively secured on opposing sides of the secondary cavity to reinforce the secondary cavity when it is expanded. In this aspect, the handbag further comprises a secondary access mechanism configured to selectively allow access to the secondary storage cavity when the storage cavity is expanded and a fastening mechanism being configured to, when the reinforcing structures are unsecured and the secondary storage cavity is collapsed, engage to fasten the at least one secondary wall and the reinforcing structures in a collapsed position adjacent to the divider, and being configured to disengage to allow the secondary cavity to expand away from the divider.

In certain embodiments of this aspect, the at least one secondary side wall comprises a pliable material. In some embodiments, the reinforcing structures comprise a first edge and a second edge opposite the first edge, where the first edge is attached to a wall defining the secondary cavity on or near the connection of the at least one secondary side wall and either the divider or the secondary bottom wall, where the first edge defines a rotation axis and the reinforcing structures can be rotated about the axis from an unsecured position to a secured position, and where the reinforcing structures are substantially parallel to the divider and secondary bottom wall when in the unsecured position, and the reinforcing structures are adjacent to the at least one secondary side wall and substantially perpendicular to the divider and secondary bottom wall when in the secured position.

In various embodiments, the primary storage cavity is defined by a first primary side wall, a second primary side wall, a third primary side wall, a fourth primary side wall, and the divider, and the secondary storage cavity, when expanded, is defined by a first secondary side wall, a second secondary side wall, a third secondary side wall, a fourth secondary side wall, the divider, and the secondary bottom wall. In some embodiments, the reinforcing structures and secondary storage cavity comprise a securing mechanism configured to automatically secure the reinforcing structures in a secured position when the reinforcing structures are positioned adjacent the at least one secondary side wall and are substantially perpendicular to the divider and the secondary bottom wall.

In certain embodiments, the securing mechanism comprises hook and loop fasteners positioned to automatically engage each other when the reinforcing structures are positioned adjacent to the at least one secondary side wall, a deformable tab and corresponding groove positioned to automatically engage each other when the reinforcing structures are positioned adjacent to the at least one secondary side wall, or a combination thereof. In some embodiments of this aspect, the reinforcing structures comprise a thermoplastic material, a metal, a metallic alloy, or a combination thereof. In various embodiments, the handbag further comprised a joinder mechanism configured to allow selective joinder and complete detachment of the expandable and collapsible secondary storage cavity from the materials defining the primary storage cavity. In certain embodiments of this aspect, the handbag comprises a carrying attachment connected to at least one wall defining the primary storage cavity. In others, it further comprises a primary access mechanism configured to selectively allow access to the primary storage cavity through the top or side of the handbag.

In accordance with yet another aspect of the invention, a handbag is disclosed, the handbag comprising a primary storage cavity defined by a first primary side wall, a second primary side wall, a third primary side wall, a fourth primary side wall, and a divider, wherein the divider acts as bottom wall of the primary storage cavity. In this aspect of the invention, the handbag further comprises a primary access mechanism configured to selectively allow access to the primary storage cavity through the top or side of the handbag and an expandable and collapsible secondary storage cavity. In this aspect the secondary storage cavity is disposed below the primary storage cavity when expanded, the secondary storage cavity is defined by the divider, a first secondary side wall, a second secondary side wall, a third secondary side wall, a fourth secondary side wall, and a secondary bottom wall when expanded, where the secondary side walls connect the divider and the secondary bottom wall, and the secondary side walls comprise a pliable material.

In this aspect, the handbag further comprises one pair of rigid reinforcing structures contained within the secondary storage cavity, each reinforcing structure being configured to be selectively secured adjacent to one of the secondary side walls on the opposing side of the secondary cavity from the other member of the pair, where the reinforcing structures comprise a first edge and a second edge opposite the first edge, the first edge is attached to the connection of one of the secondary side walls and either the divider or the secondary bottom wall, the first edge defines a rotation axis and the reinforcing structures can be rotated about the axis from an unsecured position to a secured position, and where the reinforcing structures are substantially parallel to the divider and secondary bottom wall when in the unsecured position, and the reinforcing structures are adjacent to one of the secondary side walls and are substantially perpendicular to the divider and secondary bottom wall when in the secured position. In this aspect, the reinforcing structures span the distance between the divider and the secondary bottom wall when secured, and the reinforcing structures and secondary storage cavity comprise a securing mechanism configured to automatically secure the reinforcing structures in the secured position, the securing mechanism comprising hook and loop fasteners positioned to automatically engage each other when the reinforcing structures are positioned adjacent to a secondary side wall.

In this aspect, the handbag further comprises a secondary access mechanism attached to one of the secondary side walls, the secondary access mechanism being configured to selectively allow access to the secondary storage cavity when the storage cavity is expanded, and a fastening mechanism being configured to, when the reinforcing structures are unsecured and the secondary storage cavity is collapsed, engage to fasten the secondary side walls, the secondary bottom wall and the reinforcing structures in a collapsed position adjacent to the divider, and being configured to disengage to selectively release the secondary side walls, the secondary bottom wall and the reinforcing structures from the collapsed position and allowing the secondary cavity to expand away from the divider. In some embodiments of this aspect, the reinforcing structures comprise a thermoplastic material, a metal, a metallic alloy, or a combination thereof.

BRIEF DESCRIPTION OF THE DRAWINGS

Exemplary embodiments of the disclosure will now be described by way of example only and with reference to the accompanying drawings, in which.

DETAILED DESCRIPTION OF EMBODIMENTS

The embodiments and apparatuses described herein provide apparatuses and articles for carrying various items, including but not limited to handbags, purses, totes, clutches and the like. These and other aspects, features and advantages of the invention or of certain embodiments of the invention will be further understood by those skilled in the art from the following description of exemplary embodiments.

One aspect of the invention relates to apparatuses, in particular apparatuses for carrying one or more personal items. In certain embodiments, the apparatus comprises a primary storage cavity and an expandable and collapsible secondary storage cavity. In some embodiments, the primary cavity is defined by one or more primary side walls and a divider that defines the bottom wall of the primary storage cavity, and the secondary storage cavity, when expanded, is defined by the divider, one or more secondary side walls, and a secondary bottom wall, where the one or more secondary side walls connect the divider and the secondary bottom wall.

In various embodiments, the apparatus comprises at least one pair of rigid reinforcing structures contained within the secondary storage cavity, each reinforcing structure being configured to be selectively secured adjacent to a secondary side wall on the opposing side of the secondary cavity from the other member of the pair, and where the reinforcing structures span the distance between the divider and the secondary bottom wall when secured. In some embodiments, the apparatus comprises a fastening mechanism being configured to, when the reinforcing structures are unsecured and the secondary storage cavity is collapsed, engage to fasten any secondary side walls, the secondary bottom wall and the reinforcing structures in a collapsed position adjacent to the divider, and being configured to disengage to selectively release any secondary side walls, the secondary bottom wall and the reinforcing structures from the collapsed position and allowing the secondary cavity to expand away from the divider.

Figure 1A:
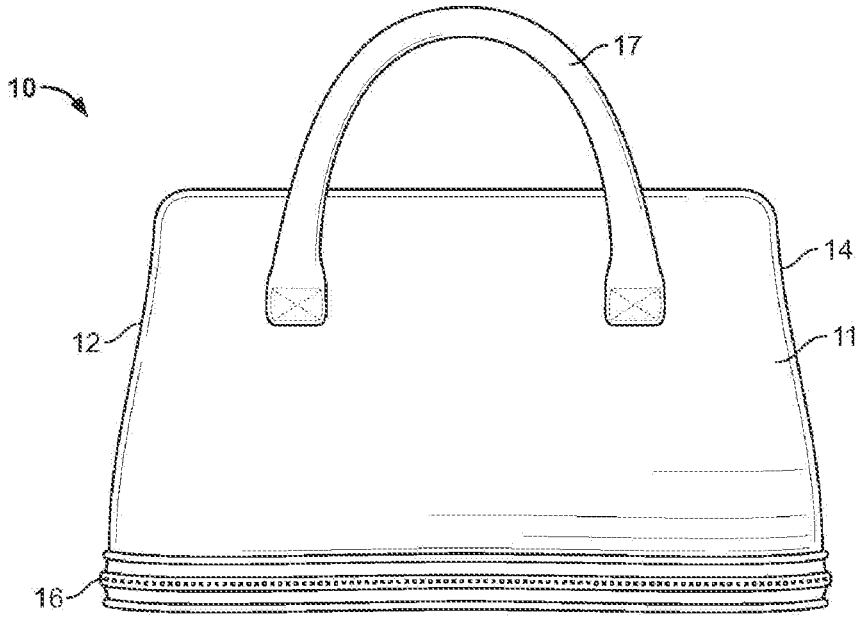
FIG. 1A shows a front view of an exemplary embodiment of the apparatus where the fastening mechanism is engaged and the secondary storage cavity is collapsed.
Figure 1B:
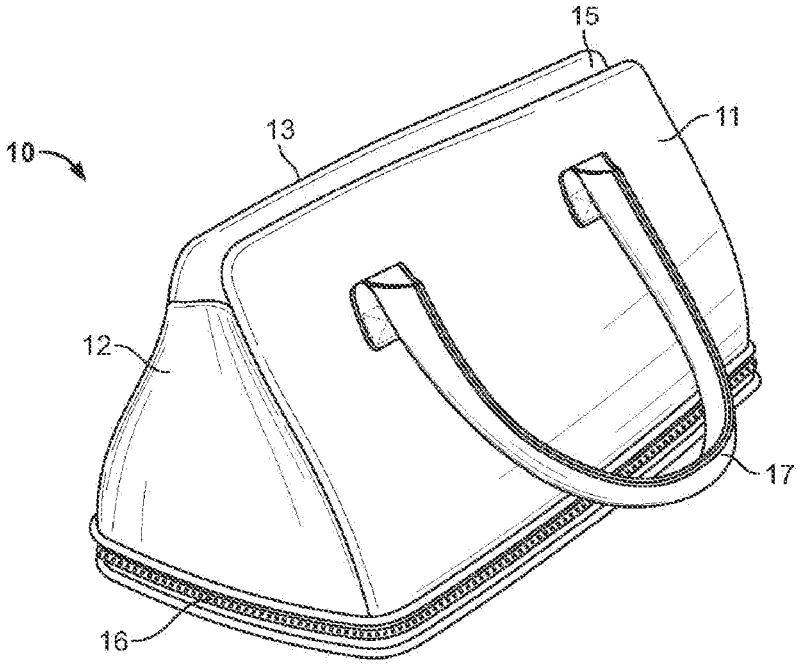
FIG. 1B shows a perspective view of an exemplary embodiment of the apparatus where the fastening mechanism is engaged and the secondary storage cavity is collapsed.

FIGS. 1A and 1B show a front and perspective view of an exemplary embodiment of the apparatus, which in this exemplary embodiment of the apparatus is a handbag 10. In this exemplary embodiment, the handbag 10 comprises a first primary side wall 11, a second primary side wall 12, a third primary side wall 13, a fourth primary side wall 14, and a divider that defines a bottom wall of the primary storage cavity. In this example, these walls define a primary storage cavity 15. The apparatus may comprise any number of side walls. In some embodiments, the apparatus comprises a single primary side wall, for example a continuous piece of material defining the sides of a cylindrical, conical, or elliptical storage cavity. In others, the apparatus comprises two primary side walls joined at least a portion of their outer edges. For example, in some embodiments, a single piece of material is folded into a "U" shape and joined together at the edges to provide two primary side walls. In yet others, the apparatus comprises three, four, five, or six primary side walls, and so on.

In certain embodiments, the divider comprises a distinct wall of material, while in others the divider comprises a section of the one or more primary side walls that forms the bottom of the cavity. For example, in some embodiments, the apparatus is a purse comprising two pieces of material attached at their side and bottom outer edges, and divider is comprised of the portions of these pieces near the bottom edge that define the bottom of the primary storage cavity. The divider may comprise one or more layers of material. In certain embodiments, the divider comprises a divider reinforcing material such a thermoplastic, a metal, a metallic alloy, carbon fiber, a polycarbonate material, an epoxy, cardboard, polyester boning, or a combination thereof.

In various embodiments, the apparatus is a handbag, purse, tote, clutch, suitcase, duffel bag, and the like, and the primary storage cavity therefore can be any shape and size appropriate for carrying one or more personal items, such as the shapes and sizes typically used for handbags, purses, totes, clutches, suitcases, duffel bags, and the like. The primary storage cavity may be any geometric or non-geometric shape. In certain embodiments, the primary storage cavity essentially has the shape of a geometric prism, including but not limited to a rectangular prism or triangular prism, an irregular prism, a cuboid, a cube, a pyramid, a cylinder, or a cone.

In some embodiments, the one or more primary side walls comprise additional pockets or storage divisions on their interior to provide compartmentalized storage inside the primary storage cavity. In certain embodiments, the pockets or divisions are shaped and sized to provide storage for particular personal items, including but not limited to a user's keys, phone or other mobile/electronic device, make-up, currency, credit cards, hairbrushes, or a combination thereof. In some embodiments, the one or more primary side walls also comprise exterior pockets to provide readily accessible storage.

In various embodiments, the apparatus comprises a primary access mechanism configured to selectively allow access to the primary storage cavity. In certain embodiments, the primary access mechanism selectively allows access through the top or side of the apparatus. The primary access mechanism may be attached to one or more of the primary side walls, a top wall defining the top of the primary storage cavity, or a combination thereof. In some embodiments, the primary access mechanism comprises one or more zippers, two or more corresponding magnets, one or more snap fasteners, hook and loop fasteners, one or more buckles, one or more buttons, one or more latches, one or more flaps, a drawstring, or a combination thereof. In certain embodiments, the primary access mechanism may comprise a lock to prevent undesired or unauthorized access to the contents of the apparatus.

The primary walls may be a wide variety of materials, and may comprise one or more layers, including but not limited to an exterior layer of material and an interior layer of material. In certain embodiments, the primary walls comprise leather, artificial leather, canvas, suede, polyvinylchloride, cotton, faux fur, linen, polyester, rayon, silk, velvet, or a combination thereof. In some embodiments, the primary walls comprise waterproof materials, such as rubber, polyvinyl chloride, polyurethane, silicon elastomers, wax, or a combination thereof, to protect the contents of the apparatus from moisture. In various embodiments, the primary walls may also comprise one or more decorative features or elements, including but not limited to jewelry, gems or facsimiles thereof, precious metals or facsimiles thereof, beads, buttons, tussles, and the like. In some embodiments, one or more of the primary walls comprises a hook, hanger or purse hanger attached to the interior or exterior of the primary wall, or a selectively attachable hook, hanger or purse hanger that is stored within the primary storage cavity when not in use.

In this exemplary embodiment, the handbag 10 further comprises a fastening mechanism 16 and an expandable and collapsible secondary storage cavity. In the examples shown in FIGS. 1A and 1B, the secondary storage cavity is collapsed. In this embodiment, the fastening mechanism is configured to engage to fasten the materials of the secondary storage cavity in a collapsed position adjacent to the divider, and disengage to selectively release the materials of the secondary storage cavity from the collapsed position to allow the secondary cavity to expand away from the divider. In this exemplary embodiment, the secondary cavity will be disposed below the primary storage cavity when expanded. In other embodiments, the secondary cavity may be disposed above or to the side of the primary storage cavity when it is expanded.

By advantageously having a selectively expandable and collapsible secondary storage cavity, a user does not have to commit to using a larger bag for situations where they may desire to carry additional personal items, nor are they required to have the foresight to switch to a larger bag before such a situation occurs. Additionally, in certain embodiments the collapsed materials are positioned such that they visually appear to simply be the bottom of the apparatus. For example, in some embodiments, the collapsed materials make up approximately one eighth or less of the total height of the apparatus when in the collapsed position. In other embodiments, the collapsed materials make up approximately one quarter or less of the total height, approximately one fifth or less, approximately one sixth or less, approximately one tenth or less, or approximately one twentieth or less. By taking up a small amount of the total height of the apparatus, the collapsed materials in these embodiments do not take away from the visually pleasing appearance of the materials defining the primary storage cavity. Thus, the apparatus still has an overall aesthetically pleasing appearance while simultaneously providing the user with the functionality of additional storage whenever desired. In certain embodiments, the fastening mechanism itself comprises components with similar or identical visual features as those defining the primary storage cavity, further enhancing the visual appearance of the apparatus.

The fastening mechanism may comprise any components that can selectively engage to hold the secondary cavity materials in a collapsed position. In some embodiments, the fastening mechanism comprises a zipper, corresponding magnets, snap fasteners, hook and loop fasteners, buckles, buttons, latches, or a combination thereof. In this example, the fastening mechanism 16 is a zipper running around the lower edges of the walls defining the primary storage cavity 15.

In certain embodiments, the fastening mechanism comprises a zipper running around the entire circumference or exterior of the apparatus and then an additional distance. These embodiments provide the advantage of allowing all of secondary cavity materials to extend away from the divider rather than have any points where the fastening mechanism is essentially engaged, such as the end point of a zipper where the two halves of the zipper are permanently affixed. In some of these embodiments, the zipper ends in the middle of a secondary side wall and is always fastened at this point so a user can easily reengage the fastening mechanism, and when unzipped the unfastened sides of the zipper fan away from each other until reaching a first point where the distance between them is essentially equal to the height of the secondary storage cavity. In these embodiments the zipper extends around at least the entire circumference or exterior of the apparatus after the first point. Thus, when the zipper is unzipped, all of the materials have extended away from the divider, but when zipped all of the materials are refastened into a collapsed position near the divider.

In other embodiments, the halves of the zipper are not attached at the end point and a user must re-hook the zipper together when desiring to reengage the fastening mechanism. This formation also allows the entire secondary cavity to expand away from the divider. Regardless of the type of fastening mechanism used, embodiments allowing of the materials defining the secondary cavity to fall away from the divider provide a more uniform, and therefore visually pleasing, appearance.

In some embodiments, apparatus comprises a carrying attachment. For example, the exemplary embodiment of FIGS. 1A and 1B also comprise a carrying attachment 17 that is a handle. In various embodiments, the carrying attachment comprises one or more handles, one or more shoulder straps, or a combination thereof. In certain embodiments the carrying attachment is made of one or more of the materials comprising the primary side walls, wood, plastic, cording, chain, rings, or a combination thereof. In various embodiments, the carrying attachment may comprise a hook, hanger or purse hanger.

Figure 2A:
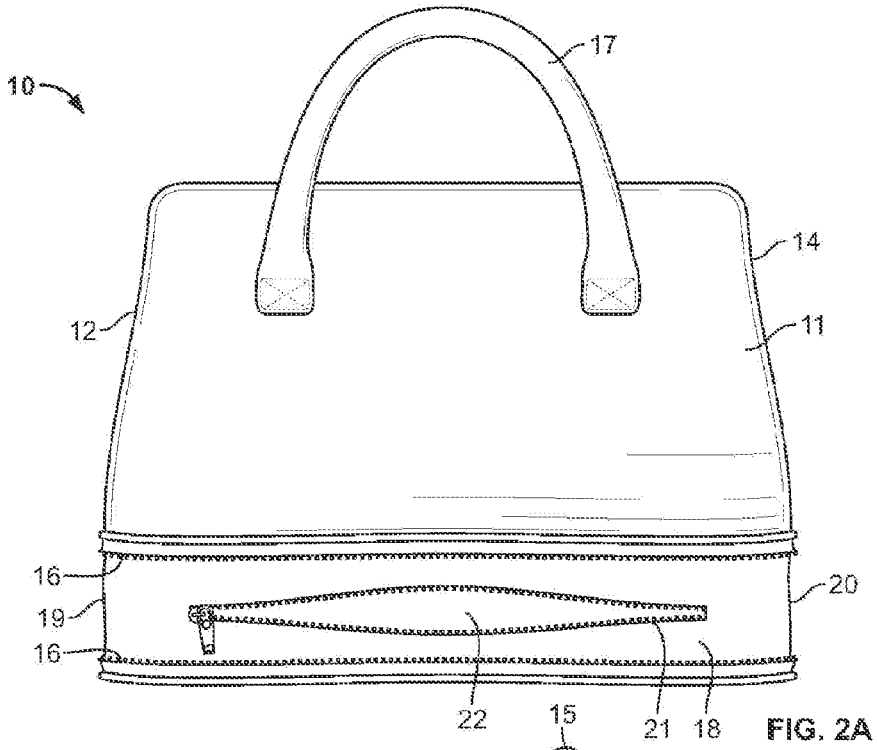
FIG. 2A shows a front view of an exemplary embodiment of the apparatus where the fastening mechanism is disengaged and the secondary storage cavity is expanded.
Figure 2B:
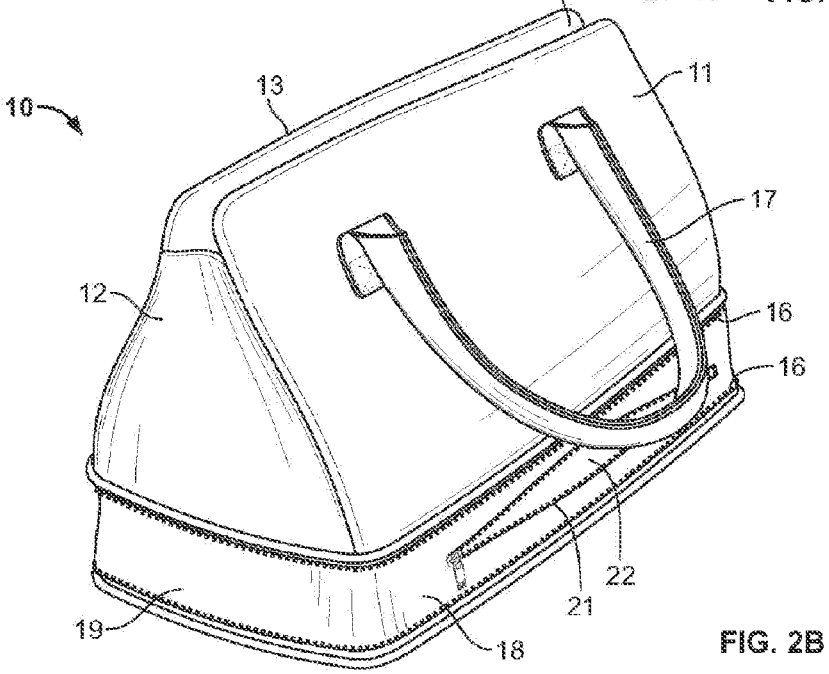
FIG. 2B shows a perspective view of an exemplary embodiment of the apparatus where the fastening mechanism is disengaged and the secondary storage cavity is expanded.

FIGS. 2A and 2B show a front and perspective view of this exemplary embodiment of the handbag 10 where the fastening mechanism 16 is disengaged such that a first secondary side wall 18, a second secondary side wall 19, a third secondary side wall, a fourth secondary side wall 20 and a secondary bottom wall all expand away from their collapsed position near the divider and define a secondary storage cavity along with the divider. The secondary storage cavity can have any number of side walls, including the same number of side walls as the primary cavity. The one or more secondary walls may comprise any of the materials used for the one or more primary side walls. In various embodiments, the one or more secondary side walls comprise additional pockets or storage divisions on their interior to provide compartmentalized storage inside the secondary storage cavity.

In certain embodiments, the secondary side walls comprise a pliable material. In various embodiments, the one or more secondary side walls comprise leather, artificial leather, canvas, suede, polyvinylchloride or a combination thereof. In some embodiments, the secondary side walls comprise one or more decorative features or elements, including but not limited to jewelry or facsimiles thereof, gems or facsimiles thereof, precious metals, beads, buttons, tussles, or the like. In various embodiments, the secondary walls comprise waterproof materials, such as rubber, polyvinyl chloride, polyurethane, silicon elastomers, wax, or a combination thereof, to protect the contents of the apparatus from moisture.

In certain embodiments, when the secondary storage cavity is expanded, it has a height approximately equal to one third of the total height of the apparatus when the cavity is expanded. In other embodiments, the secondary storage cavity has a height approximately equal to one half of the total height or more, approximately one quarter of the total height or more, approximately one fifth of the total height or more, or approximately one eighth of the total height or more.

In this exemplary embodiment, the handbag 10 further comprises a secondary access mechanism 21 attached to the first secondary side wall 18. In some embodiments the secondary access mechanism can be attached to one or more of the secondary side walls and/or the secondary bottom wall. In some embodiments, the secondary access mechanism comprises a zipper, two or more corresponding magnets, one or more snap fasteners, hook and loop fasteners, one or more buckles, one or more buttons, one or more latches, one or more flaps, a drawstring, or a combination thereof. In this example, the secondary access mechanism 21 is a zipper configured to allow selectively access to the secondary storage cavity 22.

In some aspects of the invention, the apparatus may further comprise one or more pairs of rigid reinforcing structures contained within the secondary storage cavity. In certain embodiments, each reinforcing structure is configured to be selectively secured adjacent to a secondary side wall on the opposing side of the secondary cavity from the other member of the pair. In some embodiments, the reinforcing structures span the distance between the divider and the secondary bottom wall when secured. In some embodiments, more than two reinforcing structures are contained within the cavity, including an odd number of structures, as long as the structures can combine to provide a rigid and reinforced cavity. In certain embodiments, none of the reinforcing structures are opposite from another reinforcing structure.

Figure 3A:
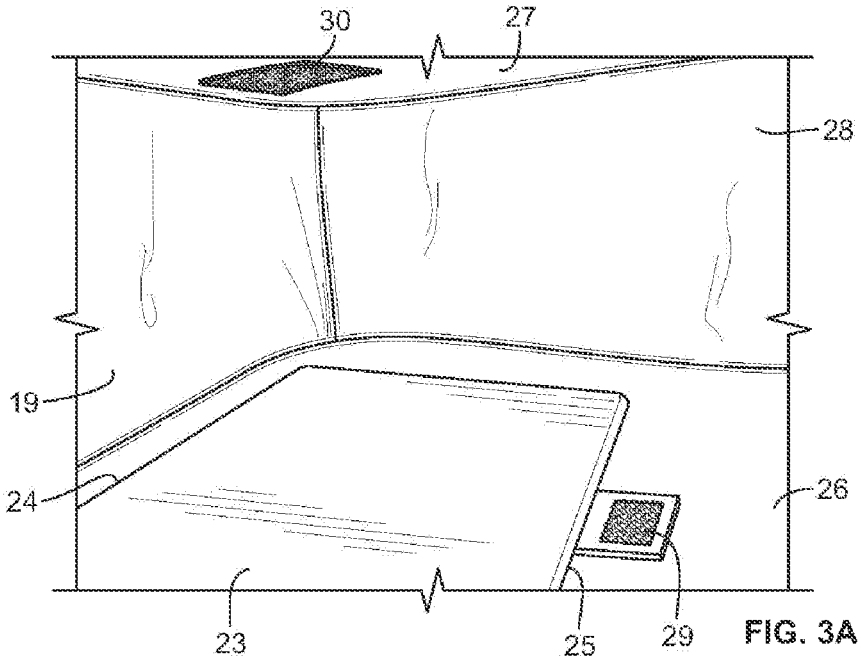
FIG. 3A shows a cross-sectional view of the interior of the secondary storage cavity of an exemplary embodiment of the apparatus, where the reinforcing structure is in the unsecured position.
Figure 3B:
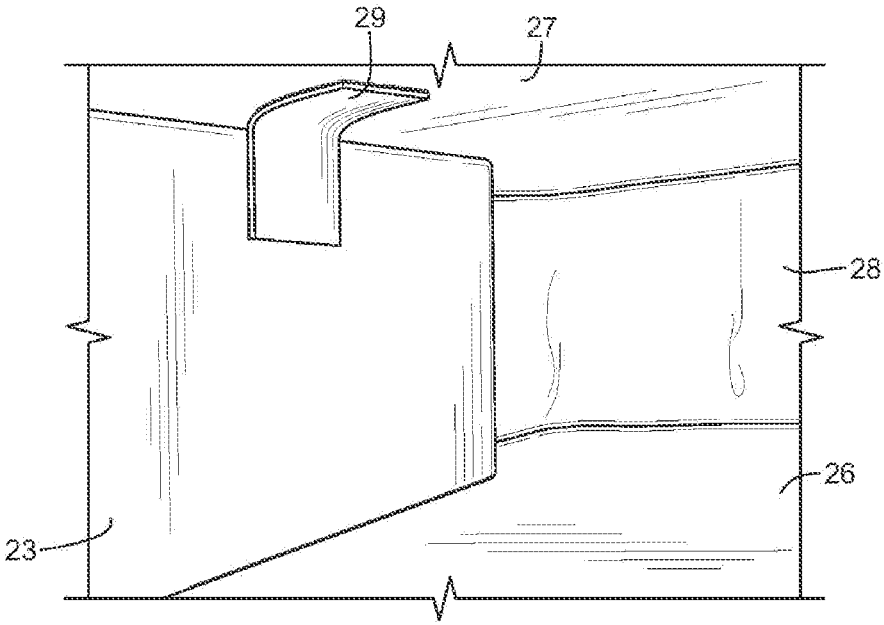
FIG. 3B shows a cross-sectional view of the interior of the secondary storage cavity of an exemplary embodiment of the apparatus, where the reinforcing structure is in the secured position.

FIGS. 3A and 3B illustrate a cross sectional view of the secondary storage cavity of exemplary handbag 10 having an exemplary embodiment of the reinforcing structures 23. In this exemplary embodiment, there is a single pair of rigid reinforcing structures 23 and the cross-sectional view of FIGS. 3A and 3B illustrate one of the structures. In some embodiments, the structures have an identical size and shape, while in others they may have different sizes and shapes. For example, in some embodiments each of the structures spans substantially all of the secondary side wall, while in others one or more leaves a portion of the side wall accessible to the user. In certain of these embodiments the exposed portion of the secondary side wall may be used as a pocket or compartment for particularized storage. In this example, the reinforcing structure 23 comprises a first edge 24 and a second edge 25 opposite the first edge 24. In this exemplary embodiment, the first edge 24 is attached to the secondary bottom wall 26 near the connection of the secondary bottom wall 26 and the second secondary side wall 19. In some embodiments, the first edge is attached on or near the connection of any secondary side wall and the secondary bottom wall, or on or near the connection of any secondary side wall and the divider.

In this exemplary embodiment, the first edge 24 defines a rotation axis and the reinforcing structure 23 can be rotated about the axis from an unsecured position to a secured position. In the exemplary embodiment illustrated in FIGS. 3A and 3B, the reinforcing structure is in the unsecured position in FIG. 3A and in the secured position in FIG. 3B. In some embodiments, including the one shown in FIGS. 3A and 3B, the reinforcing structures are substantially parallel to the bottom wall 26 and divider 27 when in the unsecured position and, when in the secured position, are adjacent to a secondary side wall, such as the second secondary side wall 19, and are substantially perpendicular to the divider 27 and the secondary bottom wall 26.

In other embodiments, the structure is not substantially parallel to a side wall, for example it may bisect the angle between the side wall and the divider or bottom wall, as long as it can reinforce the secondary cavity as a whole when in the secured position. In embodiments with the parallel and perpendicular positions, however, a user can easily and intuitively secure the reinforcing materials even without looking inside the secondary storage cavity, and unsecure them so that the structures readily return to the unsecured position, where being parallel to the secondary bottom wall and the divider easily allows a user to collapse the secondary cavity.

In certain embodiments, when the first edge of the structure are attached on or near the connection with the divider at the top of the secondary storage cavity, when a user disengages the fastening mechanism gravity will cause the structures to automatically rotate away from the divider towards their secured position as the materials of the secondary storage cavity expand away from the divider. In these embodiments, the apparatus has the advantage of providing a reinforced secondary cavity whenever the cavity is expanded without requiring the user to perform additional steps.

By reinforcing the cavity using these reinforcing structures, embodiments of the apparatus provide the advantage of protecting the contents of the cavity while still allowing the selective expansion and collapse of the cavity, including embodiments where the cavity collapses to the degree that the materials visually appear to essentially be part of the materials defining the primary storage cavity. For embodiments where the secondary cavity is disposed below the primary cavity, the reinforcing structures allow a user to set down the apparatus without having the weight of the primary contents fall onto or damage the secondary contents. Regardless of the location of the secondary cavity, a user can selectively create an additional compartment for storing fragile, easily damaged and/or expensive personal items, such as shoes, sunglasses, laptop, electronic devices, jewelry, valuables, and the like.

Embodiments of the apparatus additionally allow a user to separate items, such as shoes, they may not desire to be in contact with their typical personal items that are contained in the primary storage cavity for hygienic or other reasons. Additionally, embodiments of the apparatus allow a user to obtain all these benefits while providing a pleasing aesthetic appearance of the apparatus regardless of whether the secondary compartment is collapsed or expanded.

The reinforcing structures may be made of any material sufficiently strong to increase the rigidity of the secondary storage cavity. In certain embodiments, light-weight but strong materials are used to allow ease of transport for the user of the apparatus by keeping the weight of the apparatus relatively low but still providing the selective reinforcement. In some exemplary embodiments, the reinforcing structures comprise a thermoplastic material, a metal, a metallic alloy, or a combination thereof. In certain embodiments, the reinforcing structures comprise carbon fiber, a polycarbonate material, an epoxy, cardboard, or a combination thereof.

In some embodiments of the apparatus, the reinforcing structure and secondary storage cavity comprise a securing mechanism to secure the reinforcing structures in the secured position. In certain embodiments, the securing mechanism is configured to automatically secure the reinforcing structures in the secured position once the reinforcing structures are positioned adjacent to one of the secondary side walls. In various embodiments, the securing mechanism is configured to automatically secure the reinforcing structures in the secured position once the reinforcing structure are positioned adjacent to one of the secondary side walls and are substantially perpendicular to the divider and the secondary bottom wall.

In certain embodiments, including the exemplary embodiment illustrated in Figured 3A and 3B, the securing mechanism comprises hook fasteners 29 attached to the reinforcing structure 23 near the second edge 25 and corresponding loop fasteners 30 attached to the divider 27. In this exemplary embodiment, the reinforcing structure is rotated along the axis defined by the first edge 24, and as the structure rotates the hook fasteners automatically come into contact with the corresponding loop fasteners 30. In other embodiments, the loop fasteners may be rotated into contact with the hook fasteners. The reinforcing structures may be secured on any side or edge by the securing mechanism, or multiple sides and/or edges. For example, the securing mechanism may secure the reinforcing structure on a side edge rather than the second edge, or in addition to the second edge. Therefore, various embodiments of the apparatus advantageously allow the automatic securement of the structures during rotation rather than requiring the user to perform an additional step that may require coordination or visually examining the inside of the secondary cavity.

The securing mechanism may comprise one or more elements, including two or more corresponding magnets, one or more snap fasteners, hook and loop fasteners, one or more buttons, or a combination thereof. In some embodiments, the securing mechanism comprises a deformable tab and corresponding groove or indentation positioned to automatically engage with each other. In various embodiments, the securing mechanism comprises both hook and loop fasteners and the deformable tab and corresponding groove or indentation features.

In some embodiments, there is no additional securing mechanism and the reinforcing structures, once placed in their secured position by the user or by automatic rotation when the cavity expands, are held in place by a friction fit resulting from the weight of the primary storage cavity contents pressing down on the structures. In various embodiments, however, the structures and the corresponding areas of the divider and/or bottom wall include a securing mechanism comprising materials having a relatively high coefficient of friction with each other, including but not limited to multiple pieces rubber or multiple pieces of the same polished and uncoated metal, to further strengthen a friction fit.

In certain embodiments, the reinforcing structures or the securing mechanism comprise a protrusion feature, such as a tab, handle, or loop of material that a user can tug or pull on to quickly unsecure the reinforcing structures. This advantageously facilitates the rapid collapse of the secondary storage cavity when it is no longer needed.

In some embodiments, the reinforcing structures may be fully detached from any of the walls of the cavity and discrete parts of the structures can be selectively secured near a wall of the cavity. In certain embodiments, the securing mechanism can be configured to allow sequential attachment of discrete parts of the reinforcing structures. For example, in various embodiments, the securing mechanism secures a first edge of the reinforcing structure to establish an axis of rotation and another potion of the securing mechanism can secure a second edge of the reinforcing structure in a position where it will strengthen the cavity. Any combination of securing mechanism parts described herein may be used. In certain embodiments, two sets of corresponding hook and loop fasteners comprise the parts of the securing mechanism that connect a first edge and a second edge. These type of embodiments allow a user to completely remove the reinforcing structures when desired, for example when it is known no additional storage will be needed or when non-fragile items are going to be stored in the secondary storage cavity. This advantageously allows a user a greater degree of customization and possible uses.

In various embodiments, the materials defining the secondary storage cavity are completely detachable from the materials defining the primary storage cavity. In these embodiments, the secondary storage cavity may comprise any of the same features or components described herein or described in reference to a cavity that is always attached to the divider. In some of these embodiments, the apparatus comprises a joining mechanism configured to allow selective joinder of the materials defining the secondary storage cavity to the materials defining the primary storage cavity, as well as the selective and complete detachment of the same materials. The joinder mechanism can comprise any of the materials described herein in reference to the fastening mechanism, including but not limited to one or more snap fasteners, one or more zippers, two or more corresponding magnets, hook and loop fasteners, one or more buckles, one or more buttons, or a combination thereof. In certain embodiments, the joinder mechanism comprises corresponding snap fasteners around the periphery of a top wall of the secondary storage cavity and a divider that can join the top wall of the secondary storage cavity and the divider. In various embodiments, the materials disposed below the joinder mechanism, when the secondary cavity is attached, comprise the fastening mechanism, reinforcing structures, side walls, bottom walls, and/or secondary access mechanism. Therefore, in certain of these embodiments, a user advantageously can completely remove the materials defining the additional cavity when not needed, but still can reattach a selectively expandable and collapsible and selectively reinforcing cavity whenever desired.

In various embodiments of the apparatus, there is one or more additional storage cavities, including an expandable and collapsible tertiary storage cavity. In some of these embodiments, the materials defining the tertiary cavity are fastened to the secondary bottom wall in the same manner that the secondary materials are fastened to the divider. Any additional storage cavities, such as the tertiary storage cavity, may comprise any of the features and/or components described above in reference to the secondary storage cavity.

In some embodiments, the bottom wall of the apparatus, whether this is the secondary bottom wall, tertiary bottom wall, or any other, comprises a bottom reinforcing material such as a thermoplastic material, a metal, a metallic alloy, carbon fiber, a polycarbonate material, an epoxy, cardboard, polyester boning, or a combination thereof. In various embodiments, the bottom wall comprises a plurality of feet that prevent the body of the apparatus from coming into contact with the ground or whatever material the apparatus is set down on.

These descriptions of the apparatus are merely exemplary. In certain embodiments, the apparatus comprises additional combinations or substitutions of some or all of the components described above. Moreover, additional and alternative suitable variations, forms and components for the apparatus will be recognized by those skilled in the art given the benefit of this disclosure.

Other aspects of the invention relate to handbags. Embodiments of the handbag may comprise any of the features described above in reference to the exemplary embodiments of the apparatus, as well as additional combinations or substitutions of some or all of the components described above in reference to the exemplary embodiments of the apparatus, and vice versa. Moreover, additional and alternative suitable variations, forms and components for the handbag will be recognized by those skilled in the art given the benefit of this disclosure.

What is claimed is:

1. An apparatus comprising:

a primary storage cavity defined by at least a first primary side wall, a second primary side wall, a third primary side wall, a fourth primary side wall, and a divider, wherein the divider defines a bottom wall of the primary storage cavity, and wherein the divider comprises a reinforcing material;

a primary access mechanism configured to selectively allow access to the primary storage cavity through the top or side of the apparatus;

an expandable and collapsible secondary storage cavity;

wherein the secondary storage cavity is disposed below the primary storage cavity when expanded;

wherein the secondary storage cavity is defined by at least the divider, a first secondary side wall, a second secondary side wall, a third secondary side wall, a fourth secondary side wall, and a secondary bottom wall when expanded; and wherein the first, second, third, and fourth secondary sidewalls are permanently connected to the divider and the secondary bottom wall;

at least one pair of rigid reinforcing structures contained within the secondary storage cavity, each reinforcing structure being configured to be selectively secured adjacent to a secondary side wall on the opposing side of the secondary cavity from the other member of the pair, wherein the reinforcing structures span the distance between the divider and the secondary bottom wall when secured;

a secondary access mechanism attached to one of the secondary side walls, the secondary access mechanism being configured to selectively allow access to the secondary storage cavity when the storage cavity is expanded;

a fastening mechanism being configured to, when the reinforcing structures are unsecured and the secondary storage cavity is collapsed, engage to fasten the secondary side walls, the secondary bottom wall and the reinforcing structures in a collapsed position adjacent to the divider, and being configured to disengage to selectively release the secondary side walls, the secondary bottom wall and the reinforcing structures from the collapsed position and allowing the secondary cavity to expand away from the divider;

wherein the reinforcing structures comprise a first edge and a second edge opposite the first edge;

wherein the first edge is attached to a wall defining the secondary cavity on or near the connection of a secondary side wall and the secondary bottom wall;

wherein the first edge defines a rotation axis and the reinforcing structures can be rotated about the axis from an unsecured position to a secured position;

wherein the reinforcing structures are substantially parallel to the divider and secondary bottom wall when in the unsecured position, and the reinforcing structures are adjacent to a secondary side wall and substantially perpendicular to the divider and secondary bottom wall when in the secured position; and wherein the reinforcing structures and secondary storage cavity comprise a securing mechanism configured to automatically secure the reinforcing structures in a secured position when the reinforcing structures are positioned adjacent to one of the secondary side walls and are substantially perpendicular to the divider and secondary bottom wall.

2. The apparatus of claim 1, wherein the secondary side walls comprise a pliable material.

3. The apparatus of claim 1, wherein the reinforcing material of the divider comprises a thermoplastic material, a metal, a metallic alloy, carbon fiber, a polycarbonate material, an epoxy, cardboard, polyester boning, or a combination thereof.

4. The apparatus of claim 3, wherein the reinforcing material of the divider comprises one or more layers of material.

5. The apparatus of claim 1, wherein, when the fastening mechanism is fastened and the secondary storage cavity is collapsed, the secondary side walls, the secondary bottom wall, and the reinforcing structures have a combined height that is one sixth or less of the total height of the apparatus.

6. The apparatus of claim 1, wherein the securing mechanism comprises hook and loop fasteners positioned to automatically engage each other when the reinforcing structures are positioned adjacent to a secondary side wall, a deformable tab and corresponding groove positioned to automatically engage each other when the reinforcing structures are positioned adjacent to a secondary side wall, or a combination thereof.

7. The apparatus of claim 1, wherein the reinforcing structures comprise a thermoplastic material, a metal, a metallic alloy, or a combination thereof.

8. The apparatus of claim 2, wherein the pliable material is leather, artificial leather, canvas, suede, polyvinylchloride or a combination thereof.

9. The apparatus of claim 1, further comprising a carrying attachment connected to one or more of the walls defining the primary storage cavity.

10. A handbag comprising:

a primary storage cavity defined by at least at least a first primary side wall, a second primary side wall, a third primary side wall, a fourth primary side wall and a divider, wherein the divider defines a bottom wall of the primary storage cavity;

an expandable and collapsible secondary storage cavity, wherein the secondary storage cavity is disposed below the divider when expanded, and is defined by at least a first secondary side wall, a second secondary side wall, a third secondary side wall, a fourth secondary side wall, the divider, and a secondary bottom wall;

wherein the first, second, third, and fourth secondary side walls are permanently connected to the divider and the secondary bottom wall;

at least one pair of rigid reinforcing structures contained within the secondary storage cavity, each reinforcing structure being configured to be selectively secured on opposing sides of the secondary cavity to reinforce the secondary cavity when it is expanded and to bear the weight of the primary storage cavity;

a secondary access mechanism configured to selectively allow access to the secondary storage cavity when the storage cavity is expanded;

a fastening mechanism being configured to, when the reinforcing structures are unsecured and the secondary storage cavity is collapsed, engage to fasten the secondary side walls and the reinforcing structures in a collapsed position adjacent to the divider, and being configured to disengage to allow the secondary cavity to fall and automatically expand away from the divider;

wherein the reinforcing structures comprise a first edge and a second edge opposite the first edge;

wherein the first edge is attached to a wall defining the secondary cavity on or near the connection of the one of the secondary side walls and either the divider or the secondary bottom wall;

wherein the first edge defines a rotation axis and the reinforcing structures can be rotated about the axis from an unsecured position to a secured position; and wherein the reinforcing structures are substantially parallel to the divider and secondary bottom wall when in the unsecured position, and the reinforcing structures are adjacent to at least one of the secondary side walls and substantially perpendicular to the divider and secondary bottom wall when in the secured position.

11. The handbag of claim 10, wherein the at least one secondary side wall comprises a pliable material.

12. The handbag of claim 10, wherein the reinforcing material of the divider comprises a thermoplastic material, a metal, a metallic alloy, carbon fiber, a polycarbonate material, an epoxy, cardboard, polyester boning, or a combination thereof.

13. The handbag of claim 12, wherein the reinforcing material of the divider comprises one or more layers of material.

14. The handbag of claim 10, wherein the reinforcing structures and secondary storage cavity comprise a securing mechanism configured to automatically secure the reinforcing structures in a secured position when the reinforcing structures are positioned adjacent the at least one secondary side wall and are substantially perpendicular to the divider and the secondary bottom wall.

15. The handbag of claim 14, wherein the securing mechanism comprises hook and loop fasteners positioned to automatically engage each other when the reinforcing structures are positioned adjacent to the at least one secondary side wall, a deformable tab and corresponding groove positioned to automatically engage each other when the reinforcing structures are positioned adjacent to the at least one secondary side wall, or a combination thereof.

16. The handbag of claim 10, wherein the reinforcing structures comprise a thermoplastic material, a metal, a metallic alloy, or a combination thereof.

17. The handbag of claim 10, further comprising a primary access mechanism configured to selectively allow access to the primary storage cavity through the top or side of the handbag, and a carrying attachment connected to at least one wall defining the primary storage cavity.

18. A handbag comprising:

a primary storage cavity defined by a first primary side wall, a second primary side wall, a third primary side wall, a fourth primary side wall, and a divider, wherein the divider acts as bottom wall of the primary storage cavity;

a primary access mechanism configured to selectively allow access to the primary storage cavity through the top or side of the handbag;

an expandable and collapsible secondary storage cavity;

wherein the secondary storage cavity is disposed below the primary storage cavity when expanded;

wherein the secondary storage cavity is defined by the divider, a first secondary side wall, a second secondary side wall, a third secondary side wall, a fourth secondary side wall, and a secondary bottom wall when expanded;

wherein the first, second, third, and fourth secondary sidewalls are permanently connected to the divider and the secondary bottom wall; and wherein the secondary side walls comprise a pliable material;

one pair of rigid reinforcing structures contained within the secondary storage cavity, each reinforcing structure being configured to be selectively secured adjacent to one of the secondary side walls on the opposing side of the secondary cavity from the other member of the pair, wherein the reinforcing structures comprise a first edge and a second edge opposite the first edge;

wherein the first edge is attached to the connection of one of the secondary side walls and either the divider or the secondary bottom wall;

wherein the first edge defines a rotation axis and the reinforcing structures can be rotated about the axis from an unsecured position to a secured position;

wherein the reinforcing structures are substantially parallel to the divider and secondary bottom wall when in the unsecured position, and the reinforcing structures are adjacent to one of the secondary side walls and are substantially perpendicular to the divider and secondary bottom wall when in the secured position;

wherein the reinforcing structures span the distance between the divider and the secondary bottom wall when secured to protect any contents placed into the secondary storage cavity from the weight of any contents of the primary storage cavity; and wherein the reinforcing structures and secondary storage cavity comprise a securing mechanism configured to automatically secure the reinforcing structures in the secured position, the securing mechanism comprising hook and loop fasteners positioned to automatically engage each other when the reinforcing structures are positioned adjacent to a secondary side wall;

a secondary access mechanism attached to one of the secondary side walls, the secondary access mechanism being configured to selectively allow access to the secondary storage cavity when the storage cavity is expanded; and a fastening mechanism being configured to, when the reinforcing structures are unsecured and the secondary storage cavity is collapsed, engage to fasten the secondary side walls, the secondary bottom wall and the reinforcing structures in a collapsed position adjacent to the divider, and being configured to disengage to selectively release the secondary side walls, the secondary bottom wall and the reinforcing structures from the collapsed position and allowing the secondary cavity to expand away from the divider.

19. The handbag of claim 18, wherein the reinforcing structures comprise a thermoplastic material, a metal, a metallic alloy, or a combination thereof.

* * * * *